US009072367B2

(12) United States Patent
Kramer

(10) Patent No.: US 9,072,367 B2
(45) Date of Patent: Jul. 7, 2015

(54) FULLY ENCLOSED FOUR SEASON CAMP HAMMOCK

(71) Applicant: Paul Anthony Kramer, Woodstock, GA (US)

(72) Inventor: Paul Anthony Kramer, Woodstock, GA (US)

( * ) Notice: Subject to any disclaimer, the term of this patent is extended or adjusted under 35 U.S.C. 154(b) by 274 days.

(21) Appl. No.: 13/861,673

(22) Filed: Apr. 12, 2013

(65) Prior Publication Data

US 2014/0304911 A1 Oct. 16, 2014

(51) Int. Cl.
*A45F 3/22* (2006.01)

(52) U.S. Cl.
CPC ..... *A45F 3/22* (2013.01)

(58) Field of Classification Search
CPC ..... A45F 3/22; A45F 3/24; A47C 17/84; E04H 15/04
USPC ..... 5/120–122, 127, 128, 414; 135/90
See application file for complete search history.

(56) References Cited

U.S. PATENT DOCUMENTS

| | | | | | |
|---|---|---|---|---|---|
| 4,001,902 | A * | 1/1977 | Hall et al. | ..... | 5/121 |
| 4,071,917 | A * | 2/1978 | Mojica | ..... | 5/121 |
| 4,308,883 | A * | 1/1982 | Malone | ..... | 135/90 |
| 4,975,994 | A * | 12/1990 | Barmettler | ..... | 5/120 |
| 5,035,012 | A * | 7/1991 | Westrich | ..... | 5/139 |
| 5,913,772 | A * | 6/1999 | Clark | ..... | 5/121 |
| 6,418,577 | B1 * | 7/2002 | Murphy | ..... | 5/127 |
| 6,711,763 | B2 * | 3/2004 | Batchelder et al. | ..... | 5/120 |
| 6,865,757 | B2 * | 3/2005 | Hennessy | ..... | 5/120 |
| 7,627,913 | B2 * | 12/2009 | Clark | ..... | 5/120 |
| 8,356,370 | B1 * | 1/2013 | Clark et al. | ..... | 5/123 |
| 8,650,679 | B1 * | 2/2014 | Clark et al. | ..... | 5/123 |
| 8,756,729 | B2 * | 6/2014 | Clark et al. | ..... | 5/121 |
| 8,936,034 | B2 * | 1/2015 | Rhett, Jr. | ..... | 135/90 |
| 2003/0028962 | A1 * | 2/2003 | Batchelder et al. | ..... | 5/120 |
| 2003/0196265 | A1 * | 10/2003 | Hennessy | ..... | 5/120 |
| 2009/0165205 | A1 * | 7/2009 | Hennessy | ..... | 5/122 |
| 2009/0265851 | A1 * | 10/2009 | Clark | ..... | 5/122 |
| 2012/0005827 | A1 * | 1/2012 | Clark et al. | ..... | 5/121 |
| 2014/0158174 | A1 * | 6/2014 | Rhett, Jr. | ..... | 135/121 |
| 2014/0196209 | A1 * | 7/2014 | Macaskill, | ..... | 5/121 |
| 2014/0304911 | A1 * | 10/2014 | Kramer | ..... | 5/121 |

* cited by examiner

*Primary Examiner* — Robert G Santos

(57) ABSTRACT

A camp hammock in which the fabric of the hammock bed is cut in such a way that once the hammock is suspended between to points it allows areas of the diagonal axis of the hammock, where the occupants head and lower legs will be positioned, to hang lower than the opposing diagonal axis which crosses under the occupants lower torso. Once the fabric gives under the torso, the legs are now inline. This hammock can also be enclosed with a top enclosure to trap body heat and a bed liner that will hold an insulating pad with side pockets to hold clothing that will act to retain heat while camping in cold temperatures. This hammock may also have a gear loft attached to the ridgeline seam for storing gear. A rain fly with an adjustable peak and end walls with rain sleeves protects the hammock in wet weather.

7 Claims, 17 Drawing Sheets

FULLY ENCLOSED FOUR SEASON CAMP HAMMOCK

PARENT CASE TEXT

This application claims priority from provisional U.S. Patent Application 61/639,899 filed Apr. 28, 2012.

BACKGROUND

Camp hammocks are becoming a popular alternative to tent camping because a hammock can provide a more comfortable nights sleep than sleeping on the hard ground. But that comfort of being elevated off the hard ground, with the hammock bed sagging between two trees or vertical supports, is compromised by the hammocks two inherent problems: 1) Hammocks, when used for cold weather camping and being made of a single layer of thin fabric, have no insulating quality and lack good body heat retention. Unlike a tent, which gains insulation from the ground at the tent floor, a hammock suspended above the ground allows cold air to penetrate the bottom of the unprotected hammock, 2) Most single support axis hammocks cause the occupant to lay in a recumbent position with the head, legs and feet at higher points than the torso, making it much more difficult get a full nights sleep or to lay on one's side. Many hammock designers have tried to solve these problems with some success but each has it's own limitations and disadvantages.

On the later issue, most single support axis hammock designs are based on the Mayan and/or Brazilian hammocks. It was well understood that when these rectangular shaped hammock beds were hung between two supports and allowed a given amount of sag, they functioned better if the occupant was lying on a diagonal across the suspension axis of the hammock. Distributing the weight of the occupant's body across the suspension axis and placing the head and feet at points further from the suspension points, places the body on a much flatter plane of the sagging fabric. The wider the hammock body and the higher the angle of diagonal the occupant could lay across the suspension axis, the flatter the plane would become.

In the effort to create a hammock body that did not need to be so wide but still lay flat, as if lying on a cot, some designers added "spreaders" to each end, keeping the hammock bed open, and not allowing as much sag to the hammock body (see U.S. Pat. No. 4,001,902, U.S. Pat. No. 4,021,869, U.S. Pat. No. 6,701,549 & U.S. Pat. No. 8,161,991). This can make the hammock top heavy and unstable and still does not allow the occupant to lie on a flatter plane.

Designers of "asymmetrical" hammocks understood that, like the Mayan and Brazilian hammocks, lying across the support axis of the hammock provides much more comfort and, by allowing a given amount of sag to the hammock body, the hammock would be more stable (see U.S. Pat. No. 6,865,757). The designers state that their "asymmetrical" design will, "also support the concave areas of the torso, such as the spine". However, the weight of the occupant's body, now causing the fabric of the hammock bed to stretch on the bias of the fabrics weave, will cause the spine to bend and the hammock will now conform to that bend of the spine, not providing the support they state. What had been overlooked in their design is that the weight of the torso is much heavier than that of the legs, feet and head. So, even though the occupant is now lying on the diagonal of the hammock, allowing the body to lay in a flatter plane, the fabric's "give" under the weight of the torso will cause the legs and feet, which are not as heavy, to remain at a higher plane thus making the spine bend.

Further more, any single suspension axis symmetrical hammock, rectangular in shape or otherwise, will function better when the occupant is lying in the flatter plane of the diagonal (this was understood with the Mayan and Brazilian designs). And, once the occupant lies on the hammock, in this manner, introduces a new variable to the symmetric shape of the hammock making it asymmetric in shape when viewed from above.

Other hammock designers have designed the hammock bed in a manner that will allow a more level sleeping area while the occupant is lying along the support axis and not across it (see U.S. Pat. No. 7,020,915). This is done by cutting the fabric of the hammock bed into a shape that gives more fabric area to the head and foot section of the hammock and, once sewn together, creates a more level sleeping area. The fabric, that makes up the hammock bed, is cut so the sides of the hammock taper inward so that once suspended between two points and pulled taut, the sides keep the middle of the hammock at a higher point than both the head and foot area. These hammocks, once suspended, resemble a boat with a flat keel. The designers have stated, that by doing this, the hammock body does not need to be so wide since the occupant does not have to lie on a diagonal in order to be on a flatter plane. While this does provide a more level or flat sleeping surface, the weight of the occupant, who is now inline with the support axis, will create tension on both sides of the hammock causing the sides to tighten in around the occupant making movement inside the hammock more difficult.

BRIEF SUMMARY OF THE INVENTION

Both inherent issues of A) proper insulation/body heat retention and B) allowing the occupants head, legs and feet to lay more in line with the torso are solved with this invention. By adding insulating pockets to the inside of the hammock body and fully enclosing the top of the hammock with a breathable solid fabric to retain body heat solves Issue A).

Issue B) is solved by taking into consideration the stretch of the fabric while the occupant is laying on the diagonal and compensating for this by allowing the head and foot section of the hammock bed to hang much lower than the mid section under the occupants lower torso. The weight of the occupant's torso will now cause the fabric of the hammock bed to give along this mid section ridge line, stretching the fabric under the occupant's lower back and hips, to the match the lower hanging points of the head and foot section. And because the occupant is lying across the support axis, the tension at both hammock end suspension points will keep the sides of the hammock from tightening in on the occupant. This allows for more freedom of movement inside the hammock shelter.

DETAILED DESCRIPTION AND BEST MODE OF IMPLEMENTATION

Figure 3:
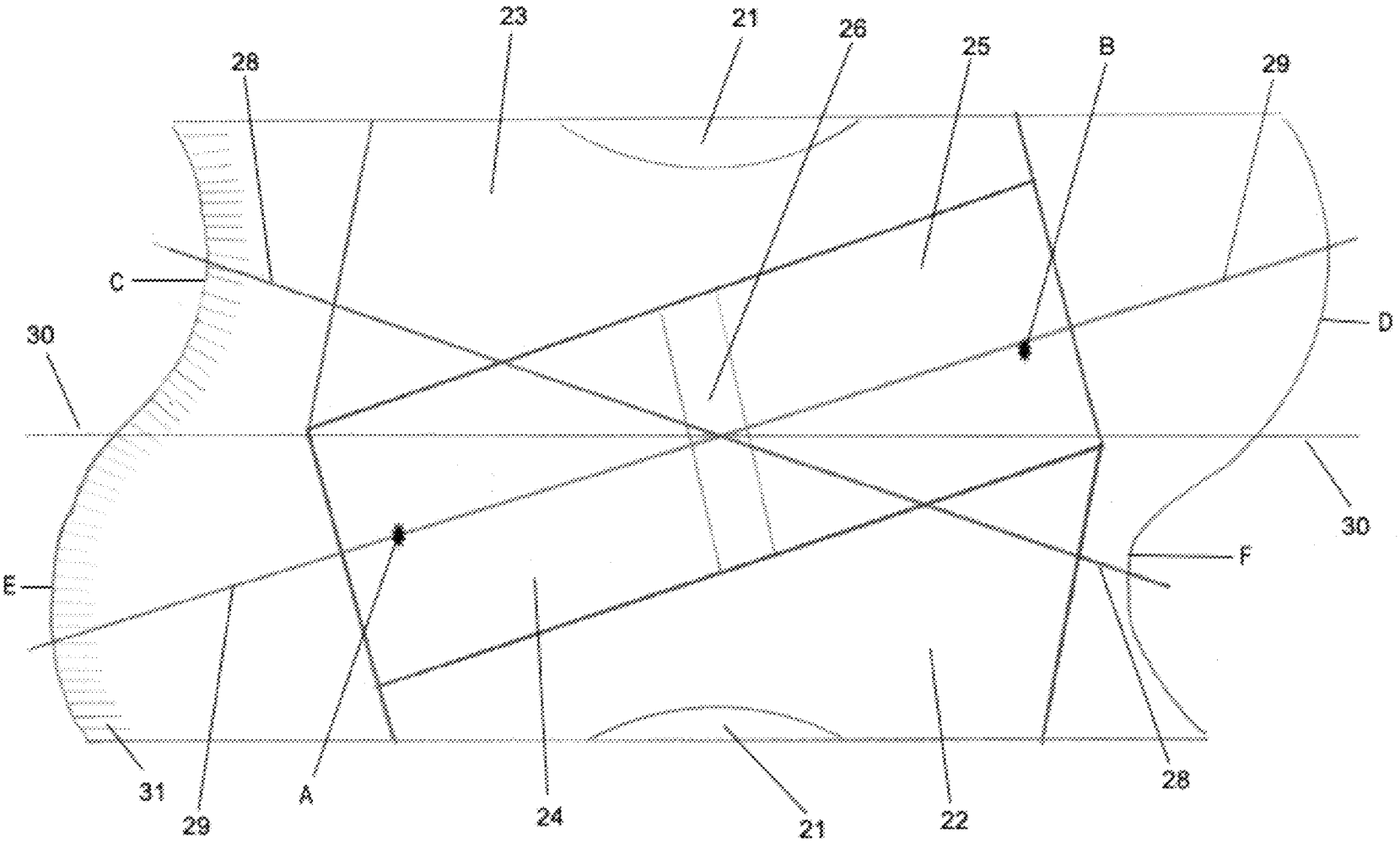
FIG. 3 presents the fabric of the hammock body as cut to its shape and before the hammock ends are folded or gathered. All axis lines, topology points and the bed and side pocket placement are also shown.

FIG. 3, which illustrates how the fabric that makes up the hammock body 5 is to be cut to its four-sided shape with curved or angled ends note that Curves C&E are more shallow than Curves D&F as shown), gives a better perspective on how the finished hammock will take its shape and allow the occupant's head, legs and feet to lay in line with the torso. As shown on FIG. 3, there are three intersecting lines: 1) The Support Axis 30, ending at End Points 10&11, 2) The Longer Diagonal Axis 29, ending at Curves E&D and, 3) The Short Diagonal Axis 28 ending at Curves C&F. The point at which these lines intersect is at the centerline of the hammock. This is approximately where the occupant's waist and hips would be. The Longer Diagonal Axis is the axis that the occupant will be lying on and is noticeably longer than the Short Diagonal Axis. This is created by cutting the fabric at each end of the hammock to the curved shapes shown in FIG. 3 as Curves C, E & D, F.

Other hammock makers/designers have used either concave or convex angles at the hammocks end in order to "adjust" the comfort and back support of their hammock depending on the weight of the occupant (see U.S. Pat. No. 6,865,757). These hammocks are stated to be "adjustable" but the user would have to untie the end wraps, adjust and re-tie the ridgeline cording, then put everything back together in order for it to be truly "adjustable". As well, there would be no way for the owner of the hammock to know if that particular hammock had either a concave or convex shape making adjustments more difficult.

By cutting the hammock ends to the convex and concave curves formed by Curves C&E and Curves D&F (as shown in FIG. 3), instead of just concave or convex hard angles, thus creating a Head Tab at the convex Curve E and a Foot Tab at the convex Curve D, the Short Diagonal Axis 28, which is formed from the concave Curves C&F, can be radically shorter than the length of the Longer Diagonal Axis 29. This provides more lower torso support once the bias of the fabric's weave gives and stretches with the weight of the occupant. Previous hammock designs do not compensate for this "give" of the fabric weave, thus, not providing as much support as this invention.

Figure 5:
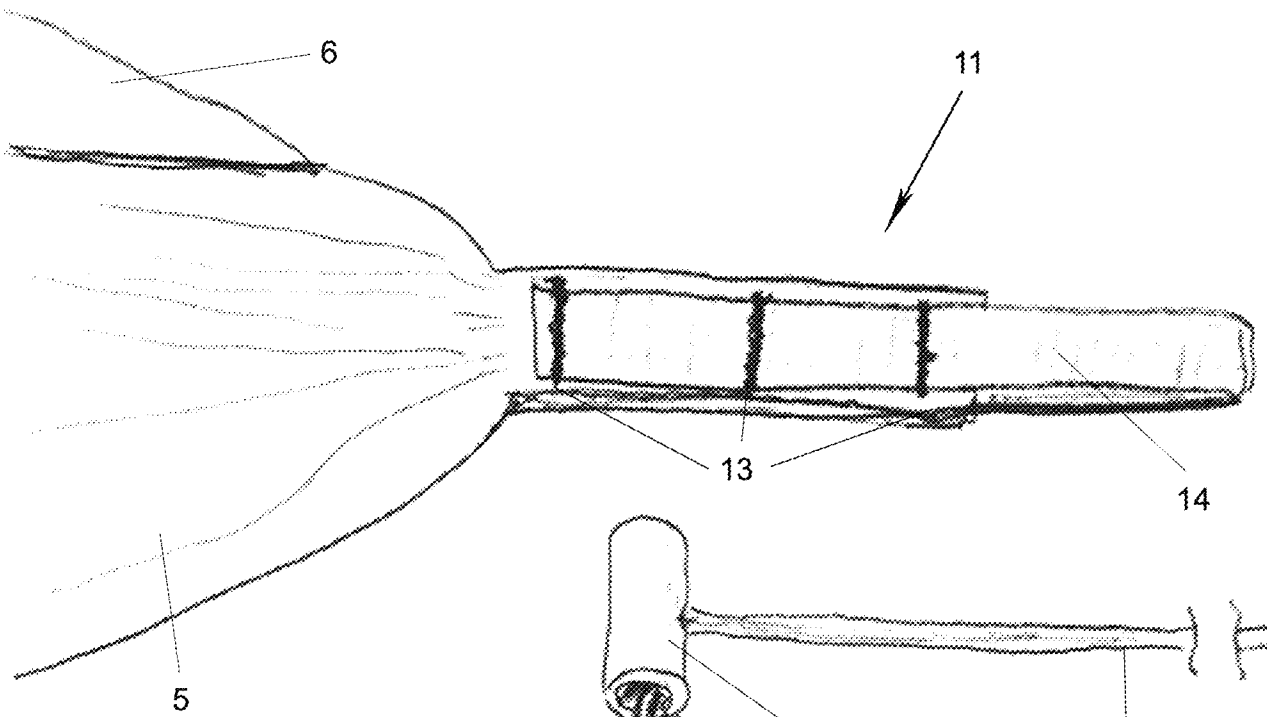
FIG. 5 illustrates how the hammock end loops are sewn to the hammock ends.

Since the weight of a person's legs and feet are much less than the weight of the upper torso and head, the foot section of this hammock has a much more pronounced curve (as shown at Curve F). This gives more material area to the Foot Tab and the topology at Point B. Once the ends of the fabric are folded or gathered and the end loops sewn in (as shown in FIG. 5), and the hammock is suspended between two vertical supports, both Points A & B will hang substantially lower than the ridge that will be formed along the Short Diagonal Axis and under the occupants lower back with Point B hanging lower than Point A.

Once the weight of the occupant's torso, waist and hips are introduced to the ridge formed at the Short Diagonal Axis 28 the fabric at that area will "give" stretching out and into shape now aligning with the head and foot sections which were previously hanging lower. This will also give the hammock its shape, which will then match the cut shape of the top enclosure 6.

Before the hammock ends are folded (see 31 shown on FIG. 3) or gathered and the end loops sewn into place, the insulating/storage pockets, which form the hammock's bed liner 24&25, and side pockets are sewn into place. The bed pocket is designed to hold a full length, inflatable camp pad or closed cell foam pad. This provides insulation under the occupant during cold weather use. The Side Pockets 22&23 (as shown on FIG. 3) can be used to stow gear and clothing. The clothing, outer layers, mid layers and under layers, can be placed inside the side pockets through the pocket opening 21 and the clothing can be stored all along the length of the camp pad or closed cell foam. This adds insulation to the sides of the hammock and further protects the occupant from cold and wind.

Figure 4:
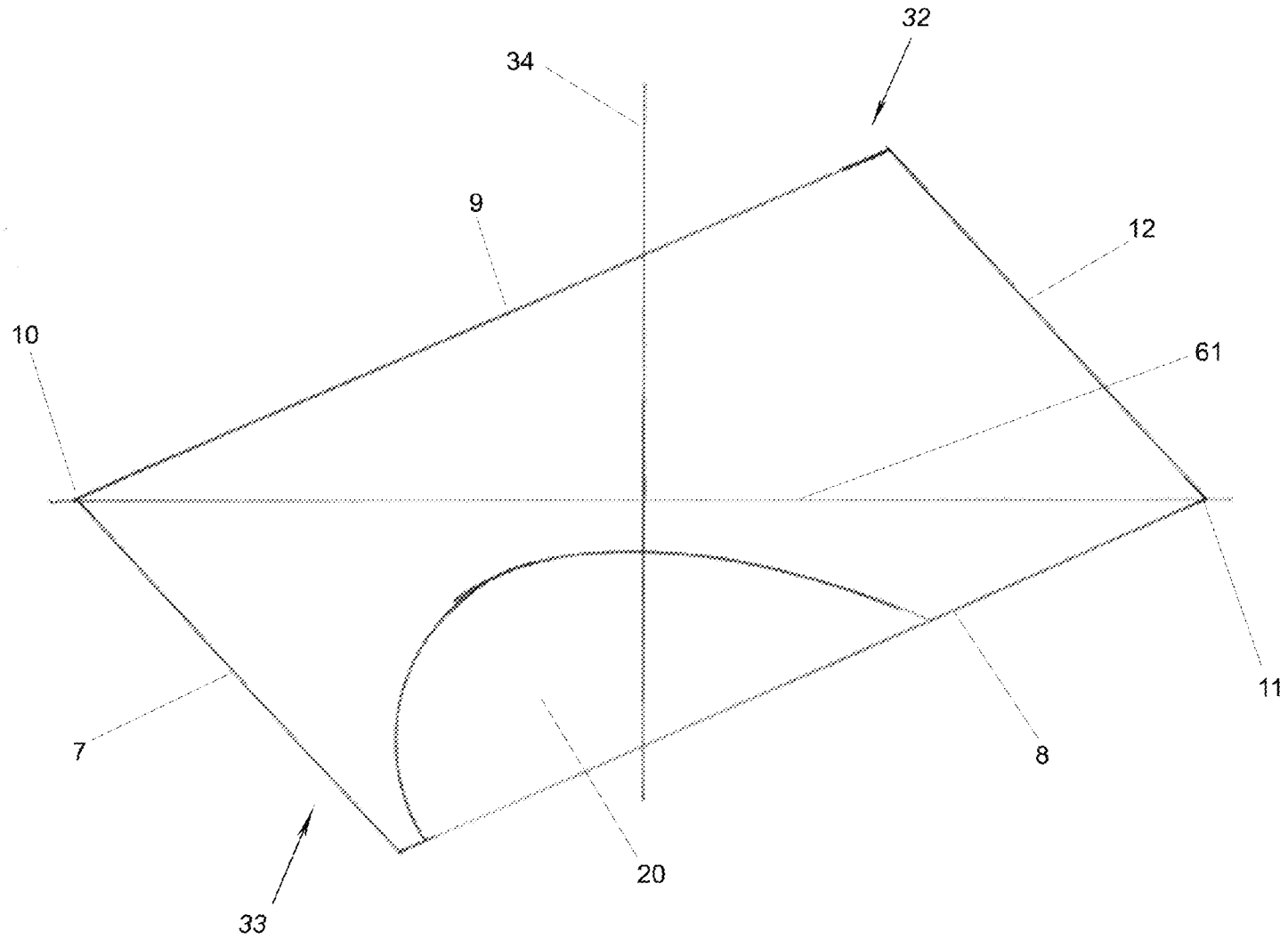
FIG. 4 shows both sides of the hammock's top enclosure as cut to shape and with the ridgeline seam sewn.

The top enclosure 6 (FIG. 4), which matches the shape of the hammock body 5 once the occupant is lying on the Longer Diagonal Axis 29, is sewn to the hammock body 5 (FIG. 3) with Sides 9&12 being sewn to one side of the hammock and Sides 7&8 being sewn to the other placing the entryway at the occupants right side. The points at which side 7 meets side 8 will be at the area of the occupant's head. The point at which side 9 meets side 12 will be at the occupant's feet and, because the occupant's body is lying on the Longer Diagonal Axis, no lateral tensioning of the top enclosure is required.

Figure 1:
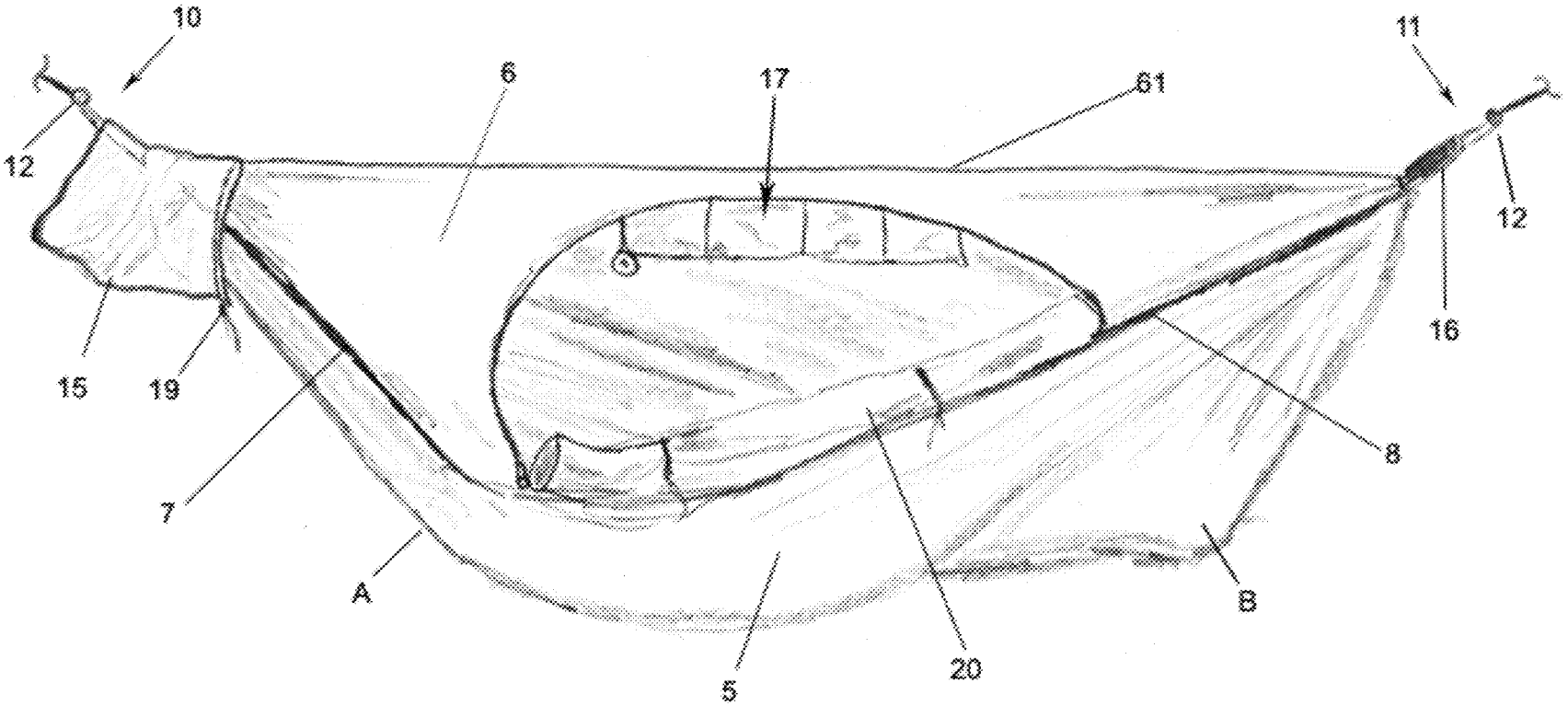
FIG. 1 shows the front side of the fully enclosed hammock with the door rolled down and showing the inside ridgeline gear loft as well as attached stuff sack and rain sleeve.
Figure 2:
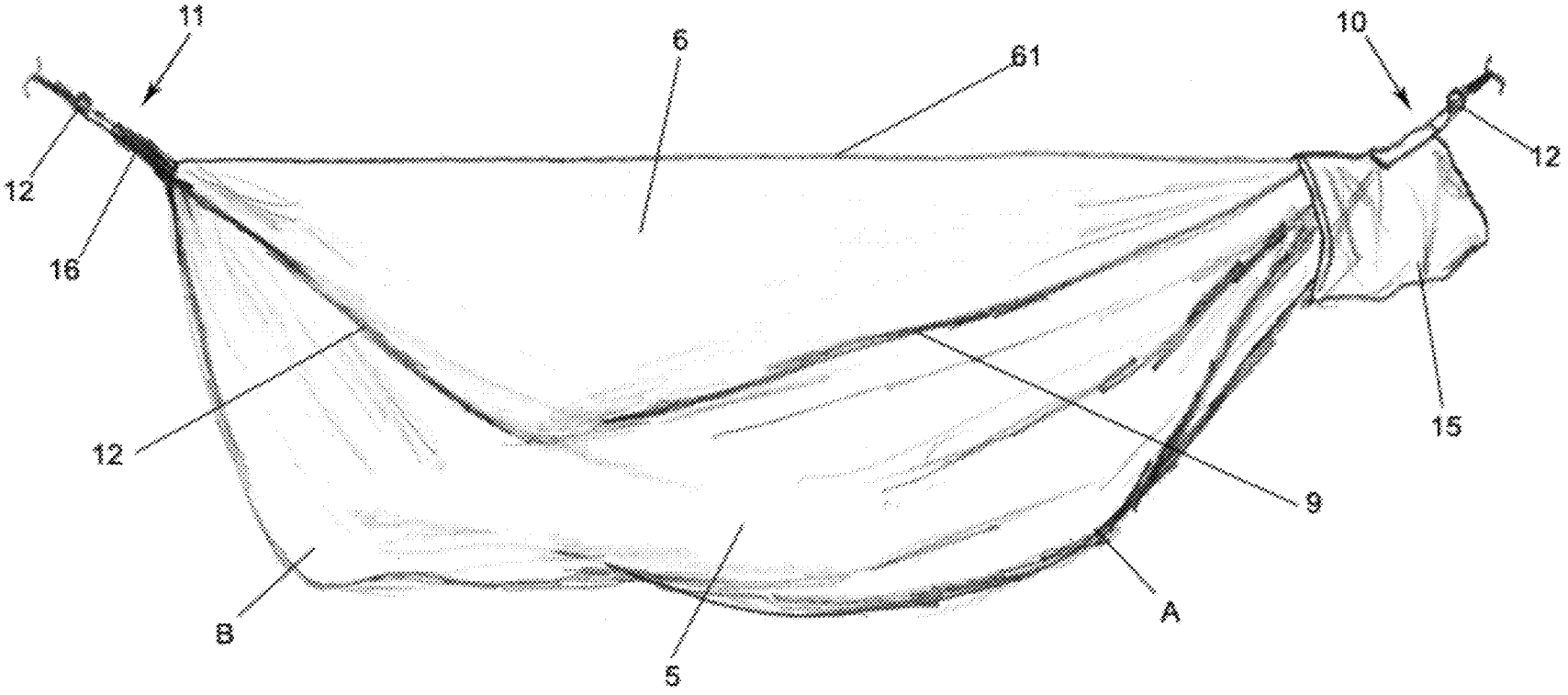
FIG. 2 illustrates the backside of the hammock.
Figure 11:
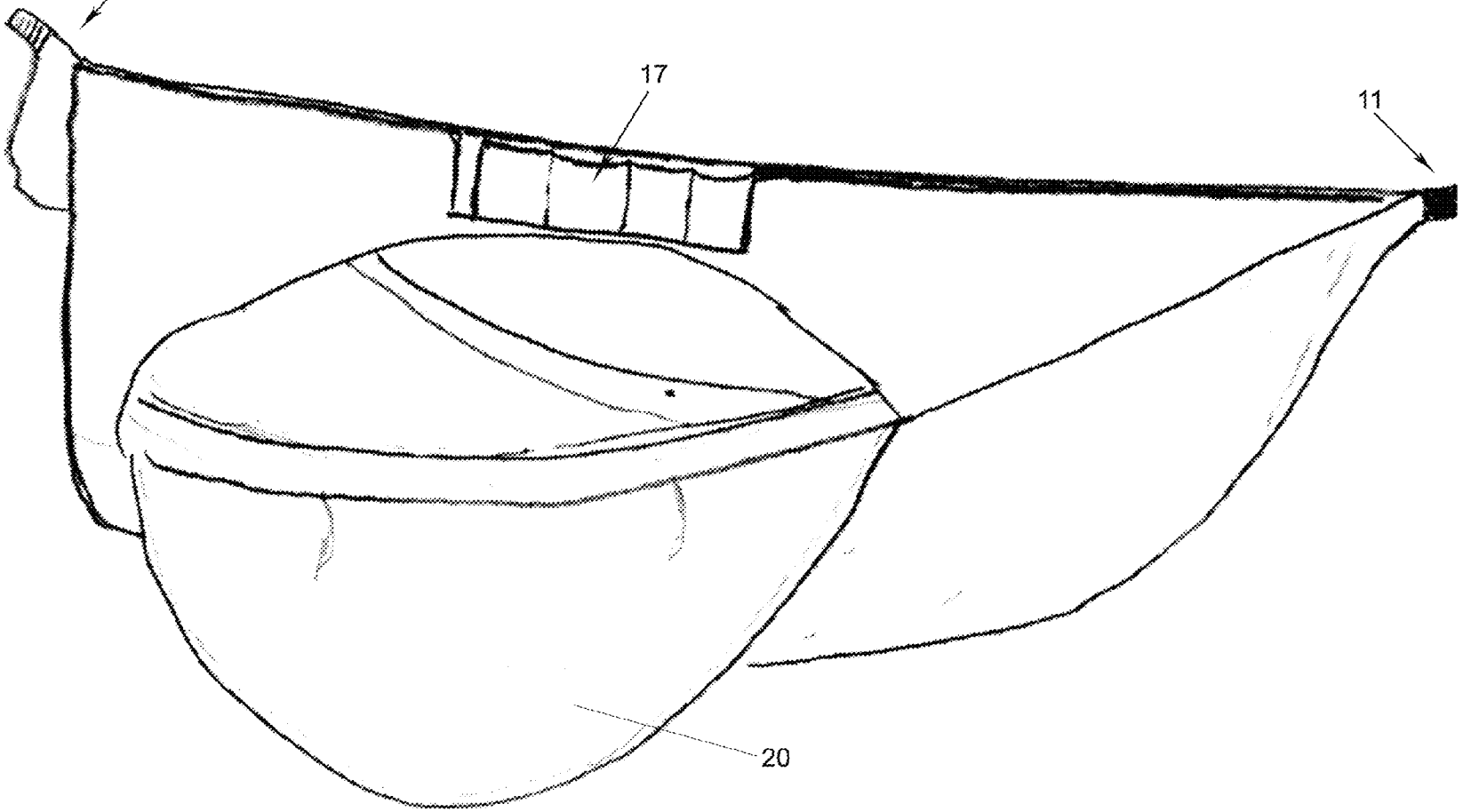
FIG. 11 illustrates the front of the hammock with the door open, unrolled and placement of the ridgeline gear loft.

The four season camp hammock embodies a top enclosure 6 that is a solid, breathable, fabric and aids in trapping body heat inside the hammock but still allowing vapor to escape out. A two-way zippered door system 20 (see FIGS. 1, 4 & 11) has a zip out solid fabric window flap and a mesh zip up door. This door system allows the occupant to regulate the temperature inside the hammock by zipping up or down the solid fabric window and allowing more ventilation with the outside mesh door. This door system can be left to hang open (as shown in FIG. 11) when unzipped or it can be rolled up using the door ties that are sewn into the hammock body 5 (as shown in FIG. 1).

This top enclosure 6 can be permanently fixed to the hammock body or may embody a top enclosure that can be removed via zippers or Velcro attachments. A removable top enclosure will not have a doorway system but embody a mesh window for ventilation.

A ridgeline seam 61 is created when the two pieces of fabric, 32 & 33, which make up the top enclosure 6, are sewn together. This may be created by using grosgrain ribbon 42 or a flat felled lap seam and runs along the hammocks single support axis from End Point 10 to End Point 11 (as shown in FIGS. 1, 2, 3 & 4). The ridgeline seam, while holding the gear loft 17, also keeps the hammock body at the correct sag once the hammock is tensioned between to vertical supports and is not adjustable. Two loops are sewn into the ridgeline seam, one on either end of the gear loft, and act as holders or gear hooks for hanging a rifle, shotgun or flash lights or any device used to illuminate the inside of the hammock.

The three season camp hammock embodies a top enclosure (FIG. 4), which is made of a mesh fabric and is attached to the hammock body in the same manner as solid top enclosure.

A summer hammock has no top enclosure or may employ the said removable top enclosure.

Figure 9:
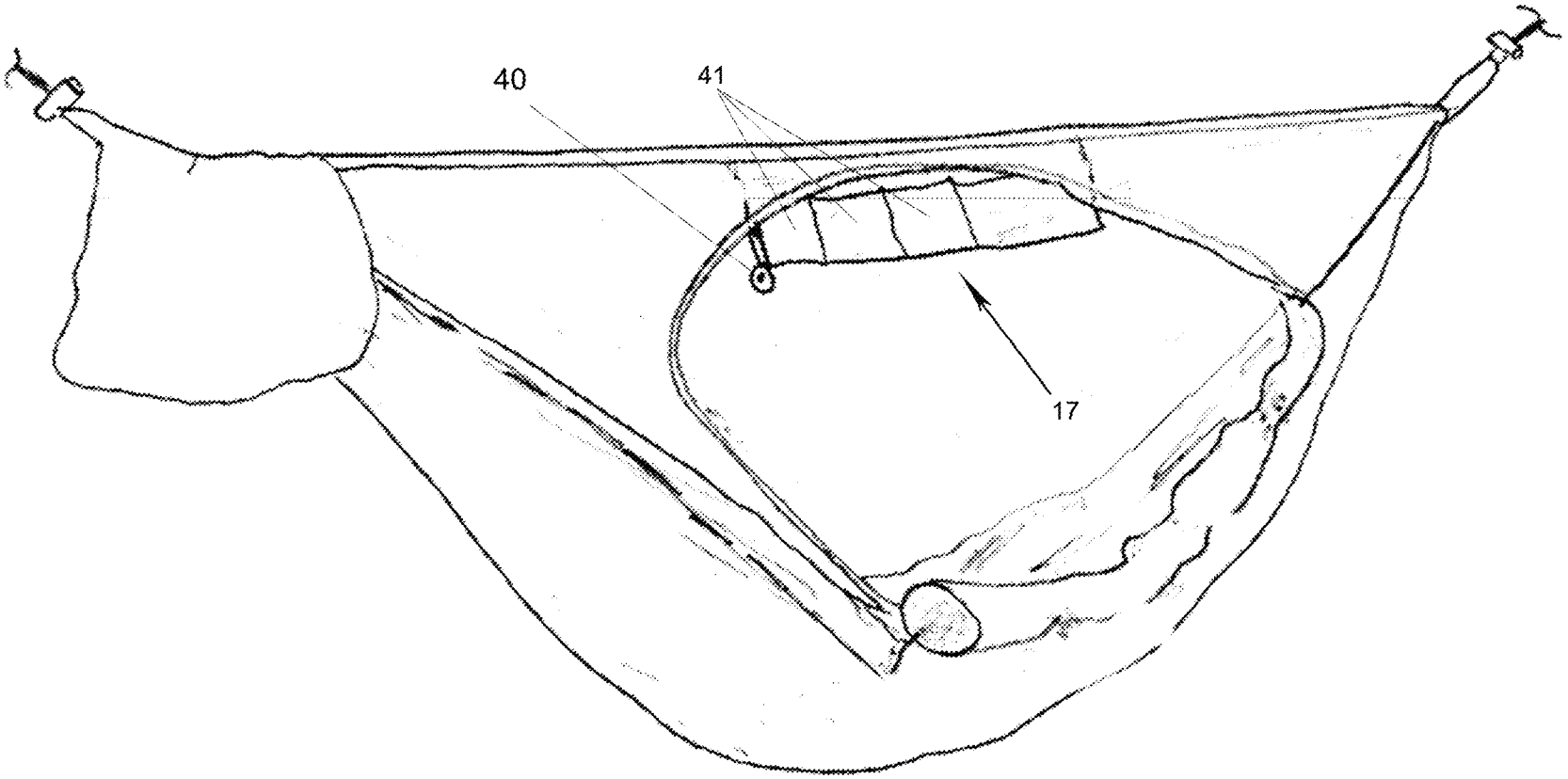
FIG. 9 illustrates a ¼ side view of the hammock with the door open, rolled and tied and the ridgeline gear loft inside the hammocks enclosure.
Figure 10:
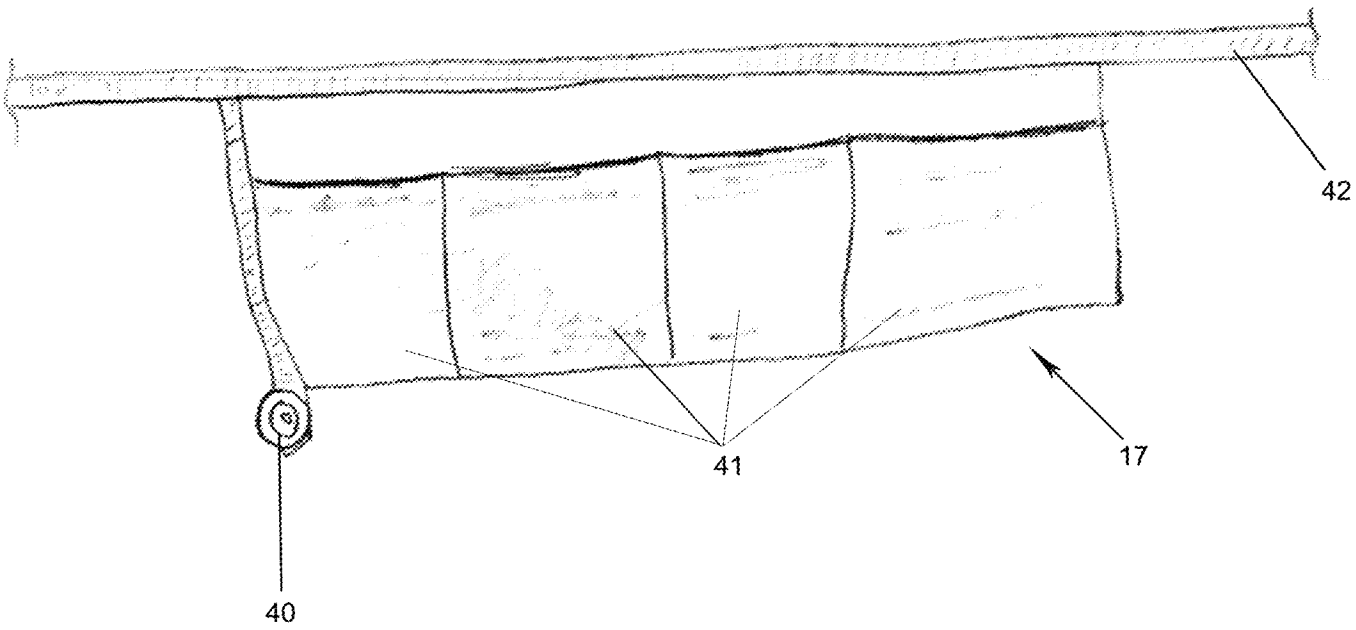
FIG. 10 presents the ridgeline gear loft with pockets and iPhone, iPod or smart device holder.

The ridgeline gear loft 17 (FIG. 10) is sewn into the ridgeline seam 61, and hangs just above the hammock's entryway (as shown in FIGS. 1 & 9). The gear loft has several small pockets 41 on the front side (facing the door) and one larger pocket on the backside. The smaller pockets allow storage for cell phones, GPS units, flash lights, MP3 players or any other gear required to be within close reach of the occupant. The larger pocket on the backside can hold maps, charts, a pistol or any other items that are too large to fit into the smaller front pockets. An attachment point 40, sewn onto the gear loft, hangs just below the gear loft at the head section of the hammock and may employ a suction cup, clip, sleeve or other device used to hold a cell phone, Smart Phone, MP3 player, GPS unit, wrist watch or any other device in which the occupant would like to monitor, hands free, while laying in the hammock.

Figure 7:
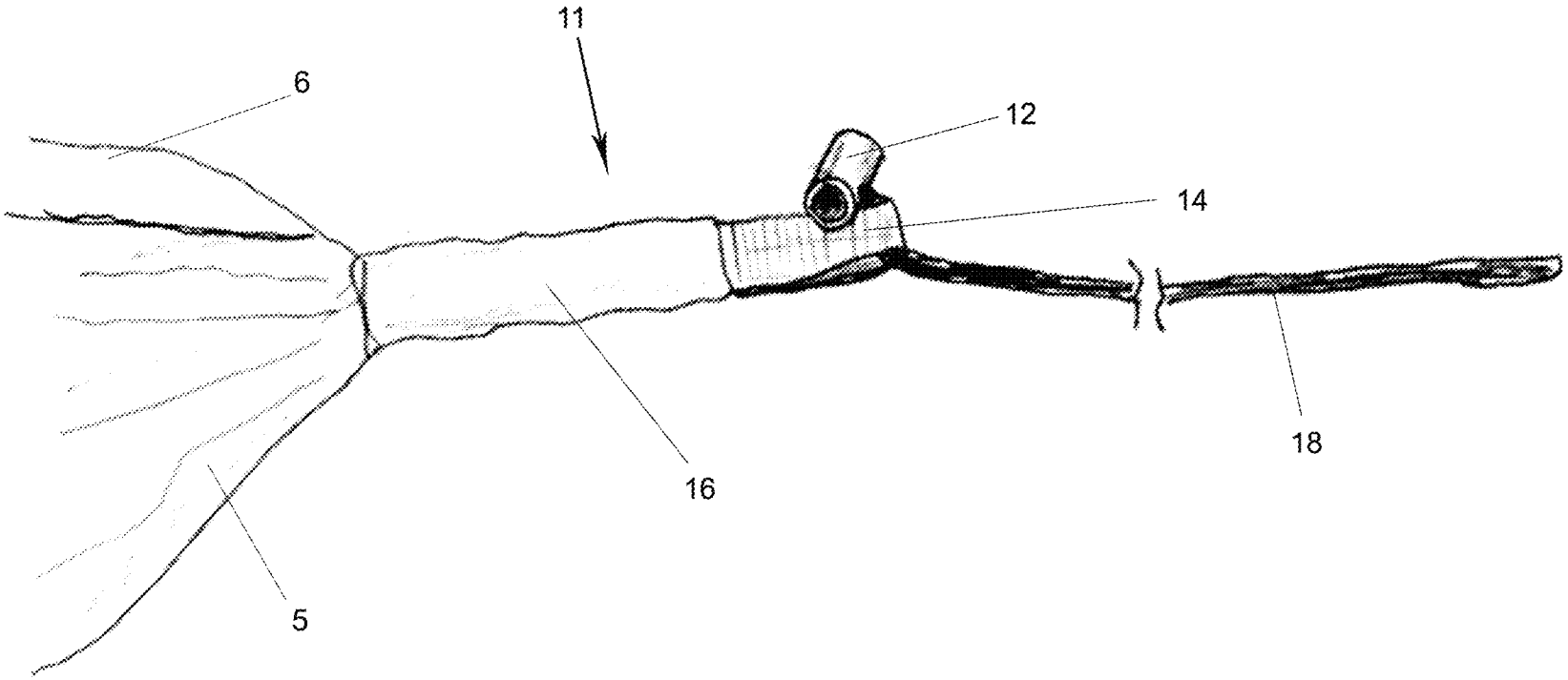
FIG. 7 gives an illustration of how the toggled support line fits into the hammock's end loop and the form fitting rain sleeve covering the end tie.
Figure 8:
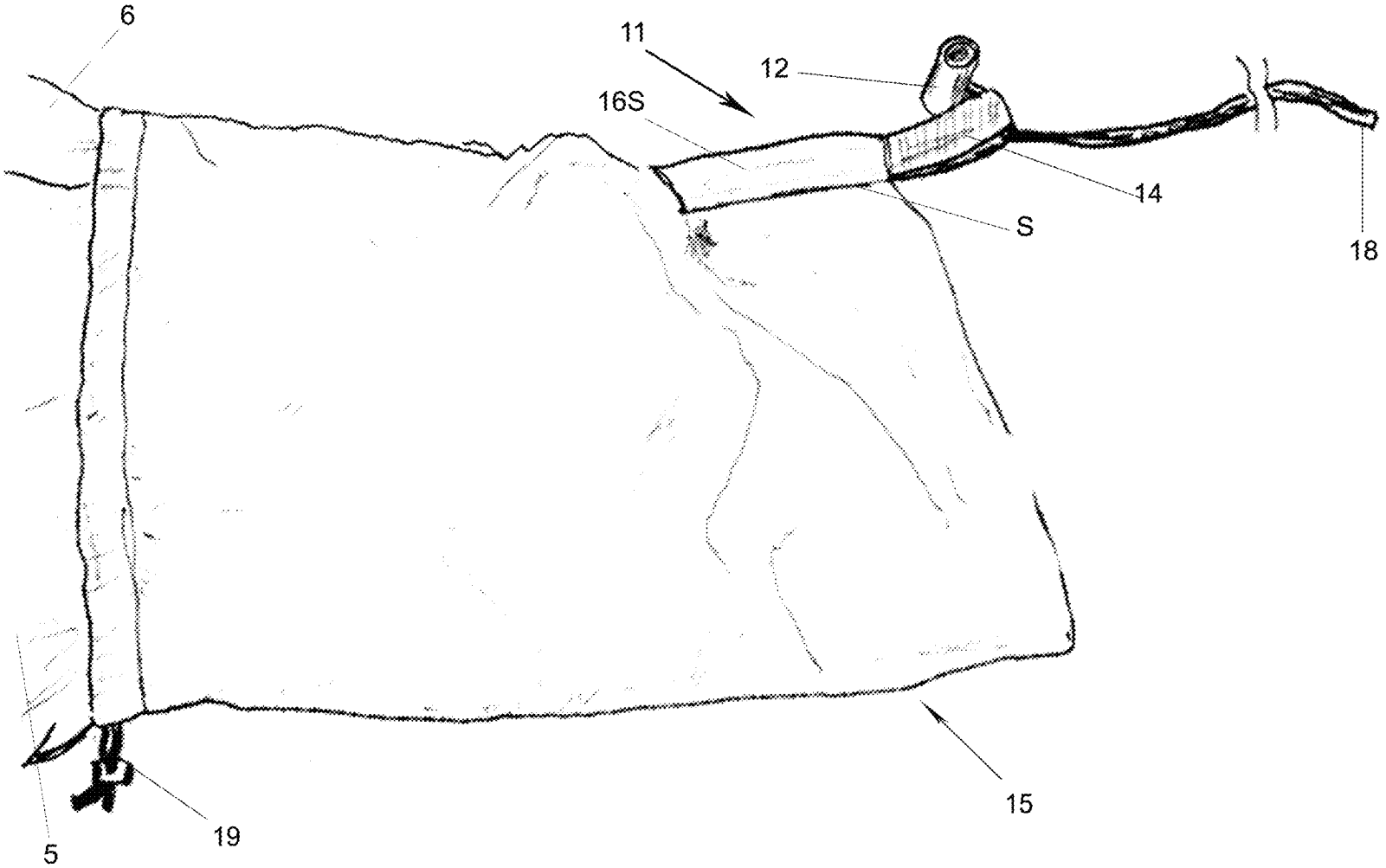
FIG. 8 shows the hammock end at the head section with the stuff sack attached to the end tie.
Figure 16:
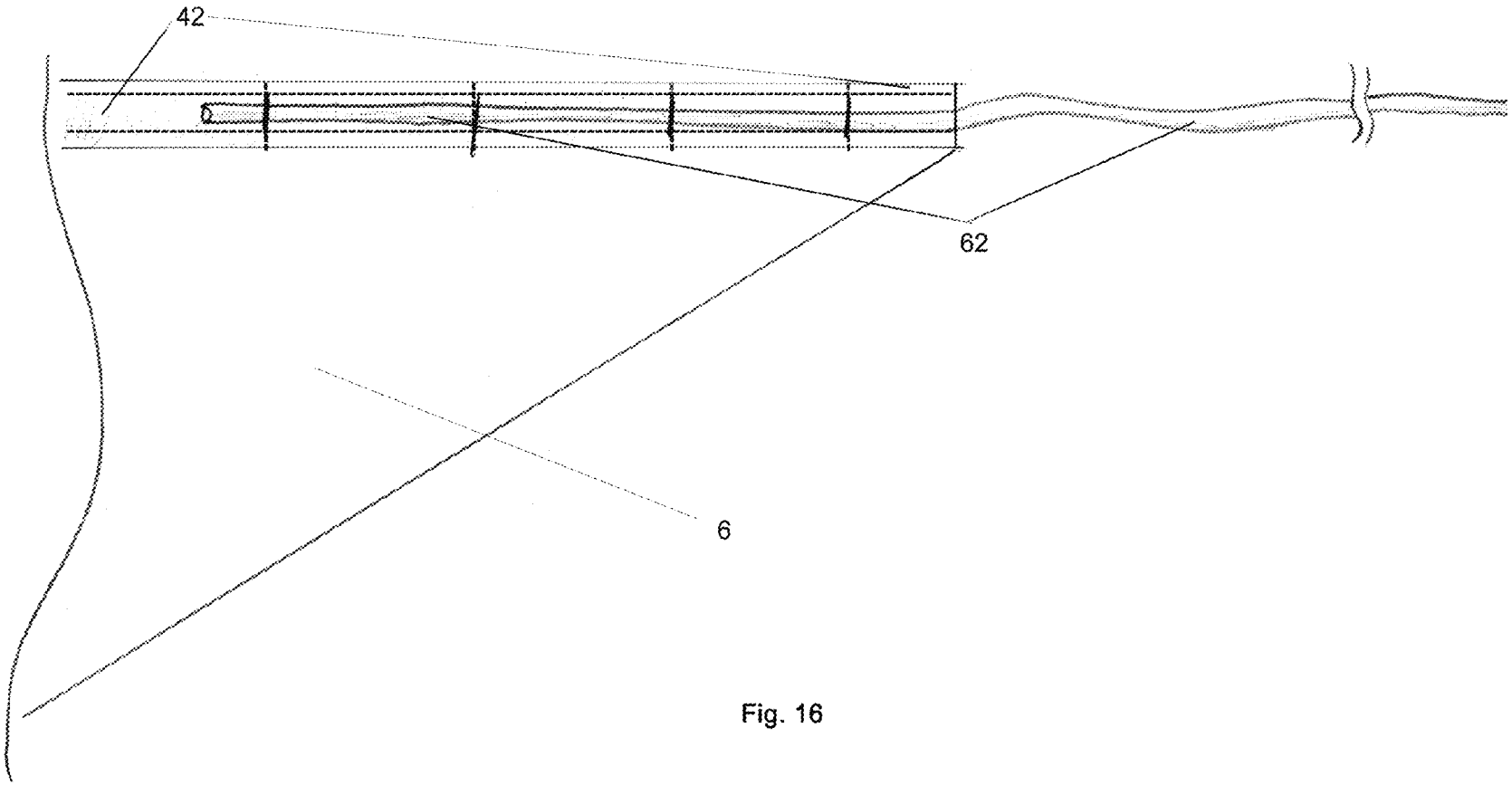
FIG. 16 shows how the nylon or poly cord, which gets wrapped around the webbing end loop, is sewn to the hammock's ridgeline seam.
Figure 17:
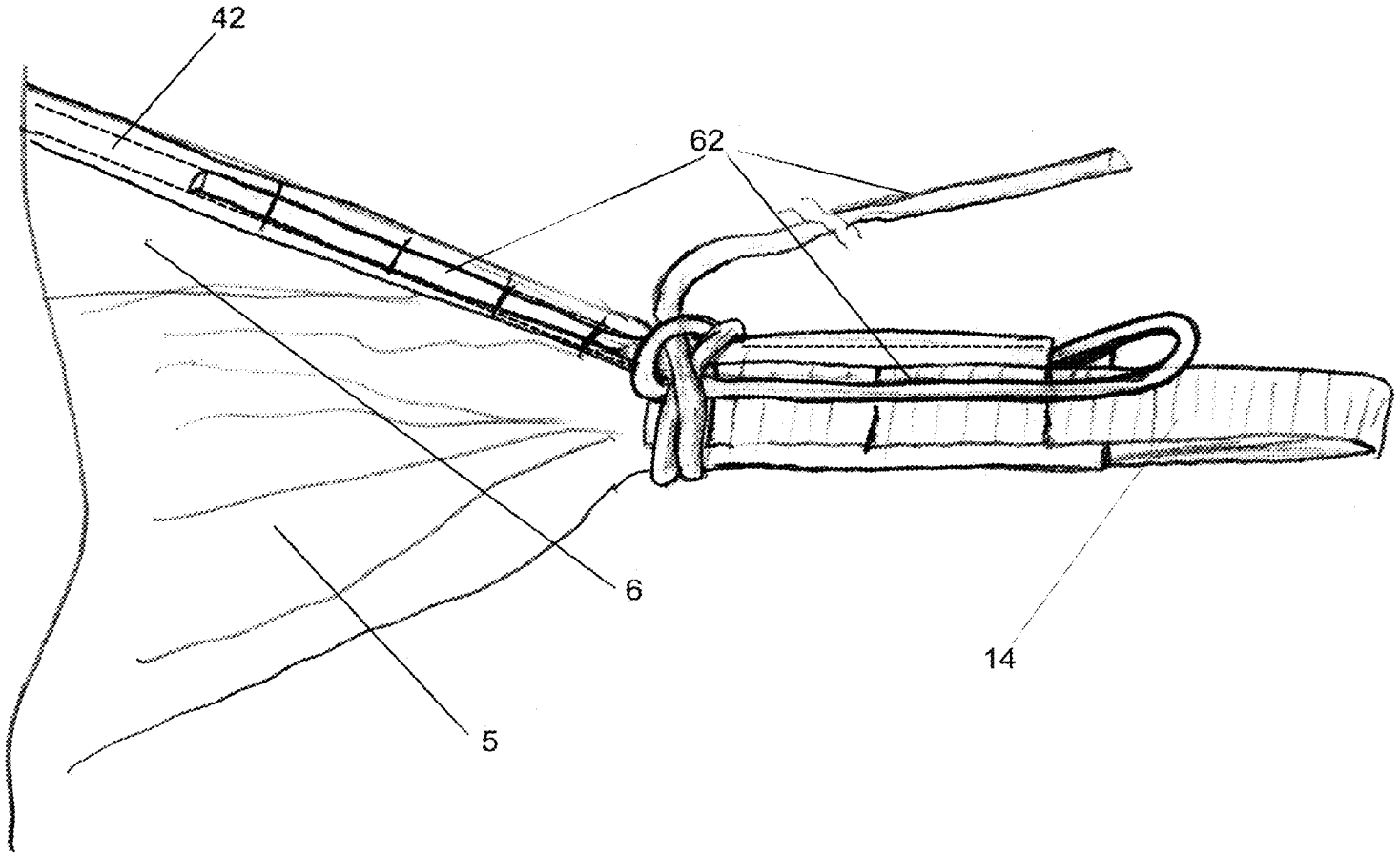
FIG. 17 illustrates the beginning steps of wrapping the nylon or poly cord around the webbing end loop.
Figure 18:
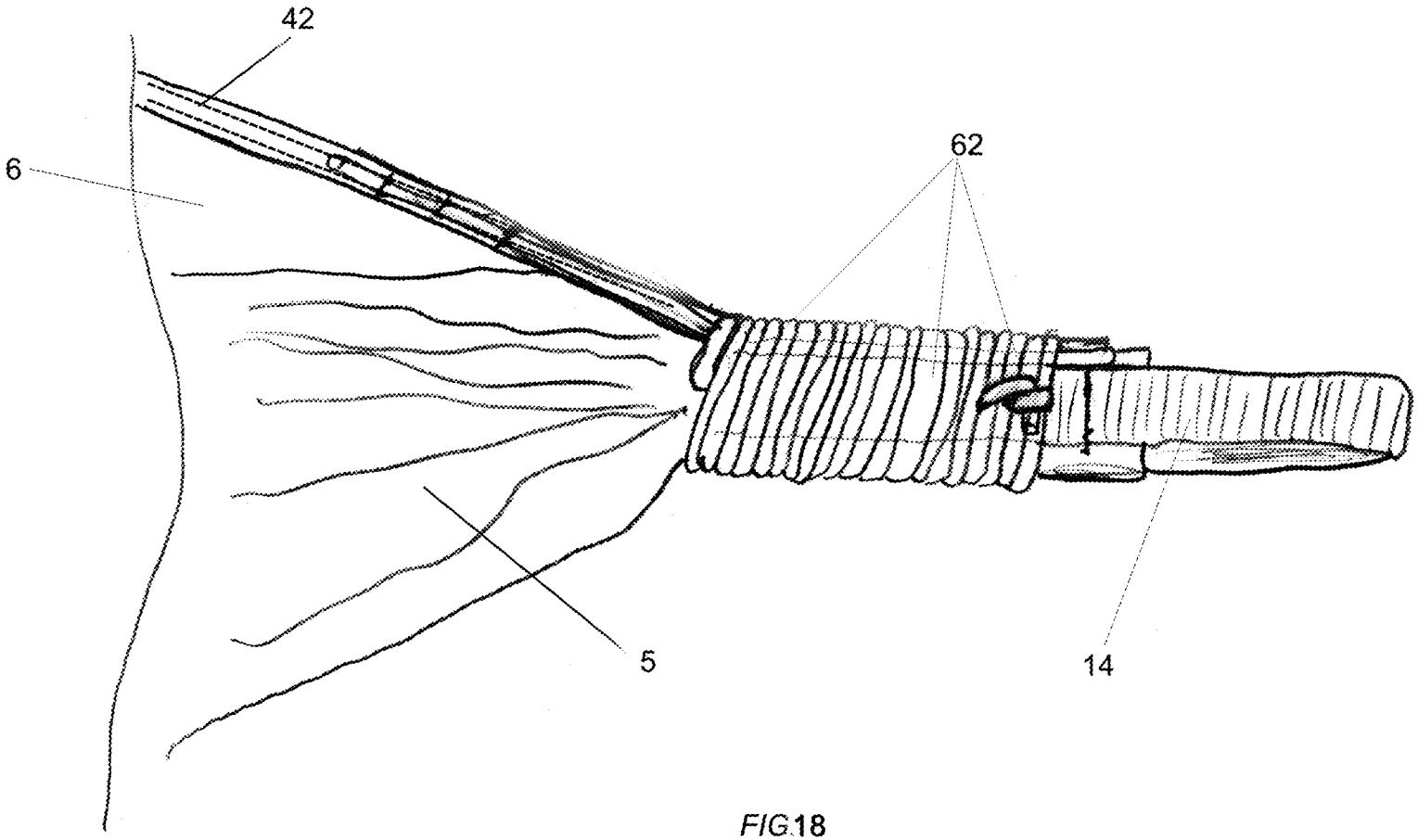
FIG. 18 demonstrates how the nylon or poly cord is wrapped and tied around the webbing end loop.

Because each end of the hammock body 5 is cut to the curved shape needed to create the tabs at each end of the Longer Diagonal Axis 29, both ends must be folded or gathered across the width of the hammock, following the contour of the curved end (as shown 31 on FIG. 3). On hammocks that are made of a heavier denier fabric, the ends can only be folded in order to attach the nylon webbing end loops (as shown in FIGS. 5, 7 & 8) as the fabric would be too thick, if gathered, to sew through. On hammocks, which are made of a lighter denier fabric, the ends can be gathered by sewing a line of loose thread that follows the edge of the curved end. The loose thread is then pulled, gathering the material. This gathered material is then wrapped with a nylon or poly cord 62 in the same manner as shown in FIGS. 16, 17 & 18 and creating an end loop to take the place of the nylon webbing as shown in FIGS. 17 & 18.

To fold the ends of the hammock made of a heavier denier fabric, the hammock maker will begin by folding, on one side of the hammocks end, the material in an over and under pattern (as if folding a paper fan) while following the outside contours of the curves C,D,E&F (as shown on FIG. 3). Once at the midway point or Support Axis 30, this pleat of folds are pinned or clamped to hold them into place before sewing. The hammock maker then repeats the folding on the other side until both sides of one end have been folded down to form two pleats of folds that are each 1.5"×5". The ends of 1"×14" webbing 14 is then sewn onto the two 1.5"×5" pleats. One end, of the webbing, sewn to one pleat and the other end sewn to the next pleat. Once the webbing is sewn into place the pleats are then folded to make one pleat (as shown in FIG. 5). This pleat is then wrapped with a nylon or poly cord 62 as shown in FIGS. 16, 17 & 18.

The webbing loop of End Point 10 (as shown in FIG. 8) is pulled through a form fitting sleeve 16S in the stuff sack 15. This sleeve, is created by sewing a seam S into the hammocks stuff sack 15. Once the webbing loop 14 has put pulled though sleeve 16S, it is then sewn into place with approximately three inches of this loop extending out of the end of the stuff sack 15, which is now permanently attached to the hammock shelter's End Point 10. The webbing loop of End Point 11 (as shown in FIG. 7) is pulled though a form fitting sleeve 16 that just covers the 1.5"×5" hammock end pleats and sewn into place. This creates webbing loops at each end of the hammock that will fit over the support lines 18 toggle button 12, hook or carabineer.

Figure 12:
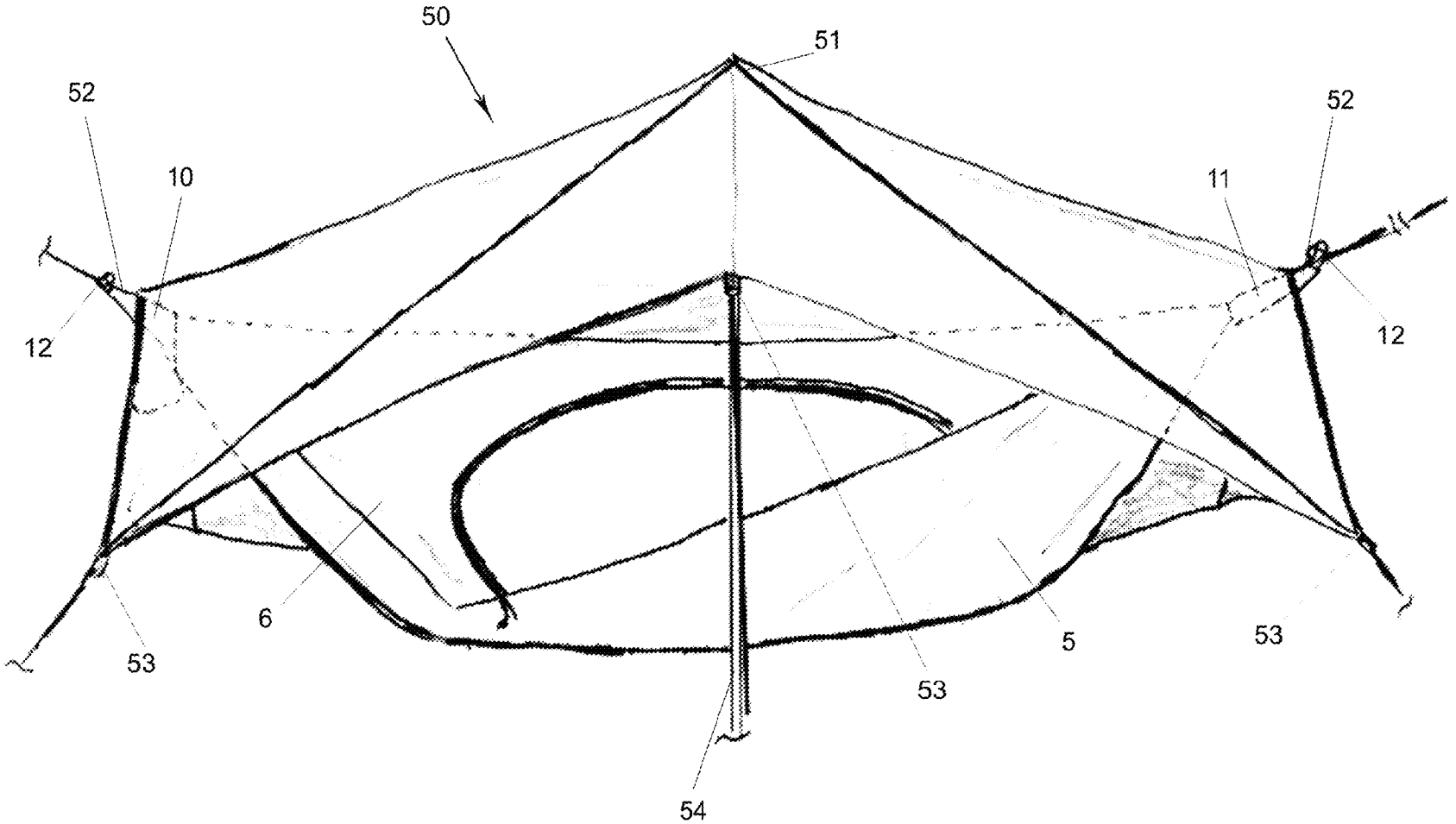
FIG. 12 presents the hammock with attached rain fly showing the peaking of the fly at its highest point.
Figure 13:
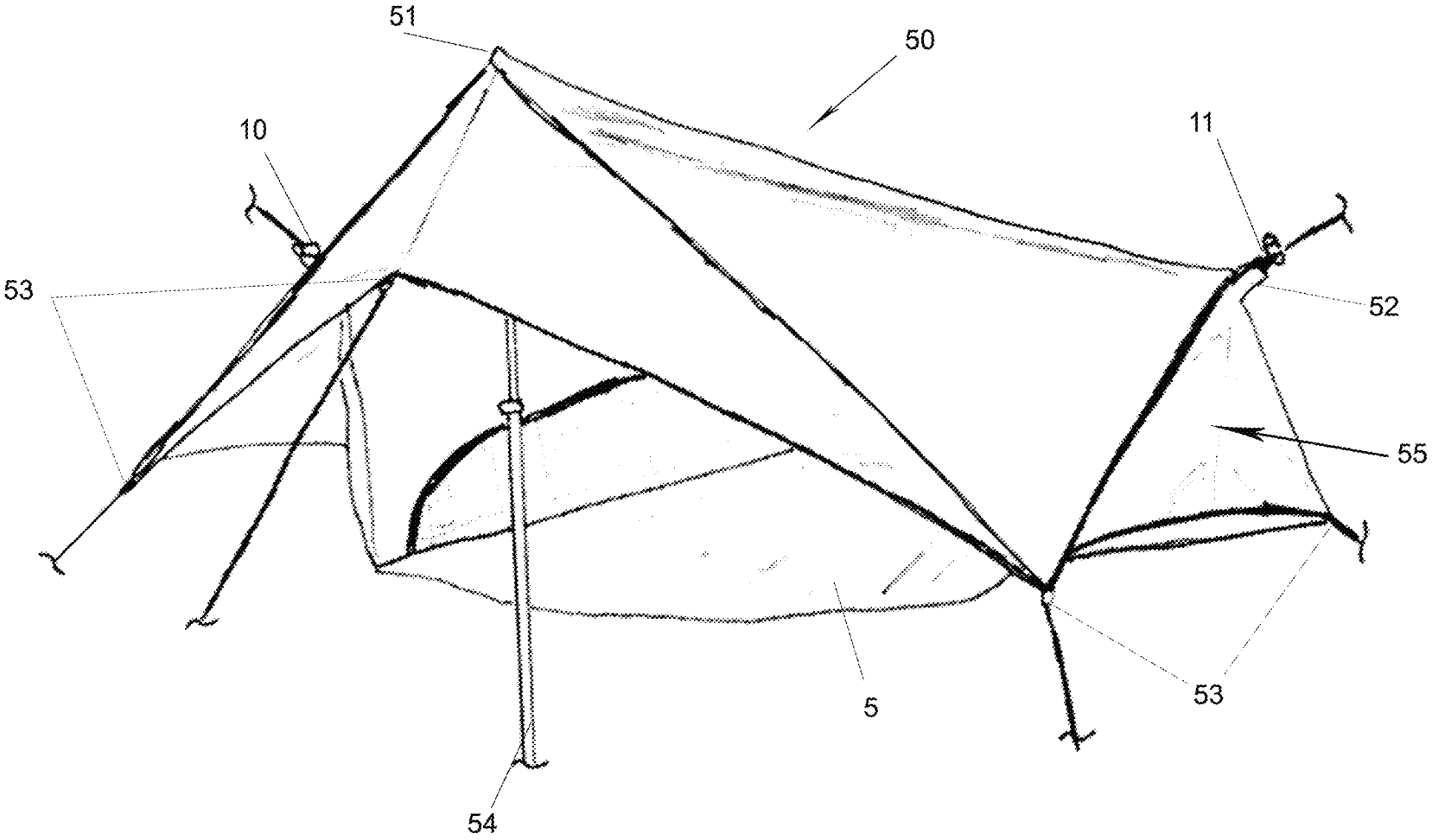
FIG. 13 gives a ¼ side view of the hammock and fly illustrating the fly end walls and rain sleeves.
Figure 14:
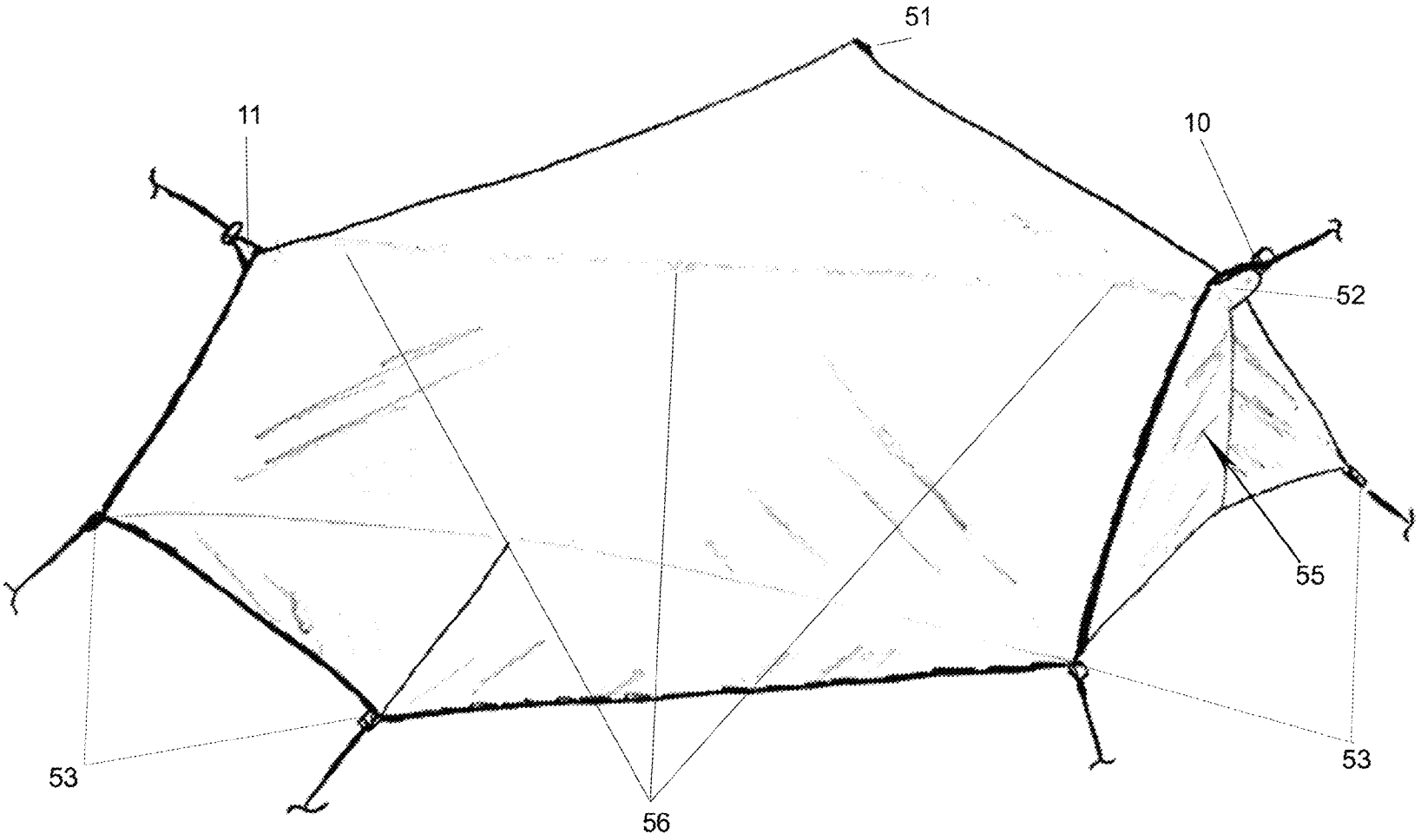
FIG. 14 shows the backside of the staked out rainfly.
Figure 15:
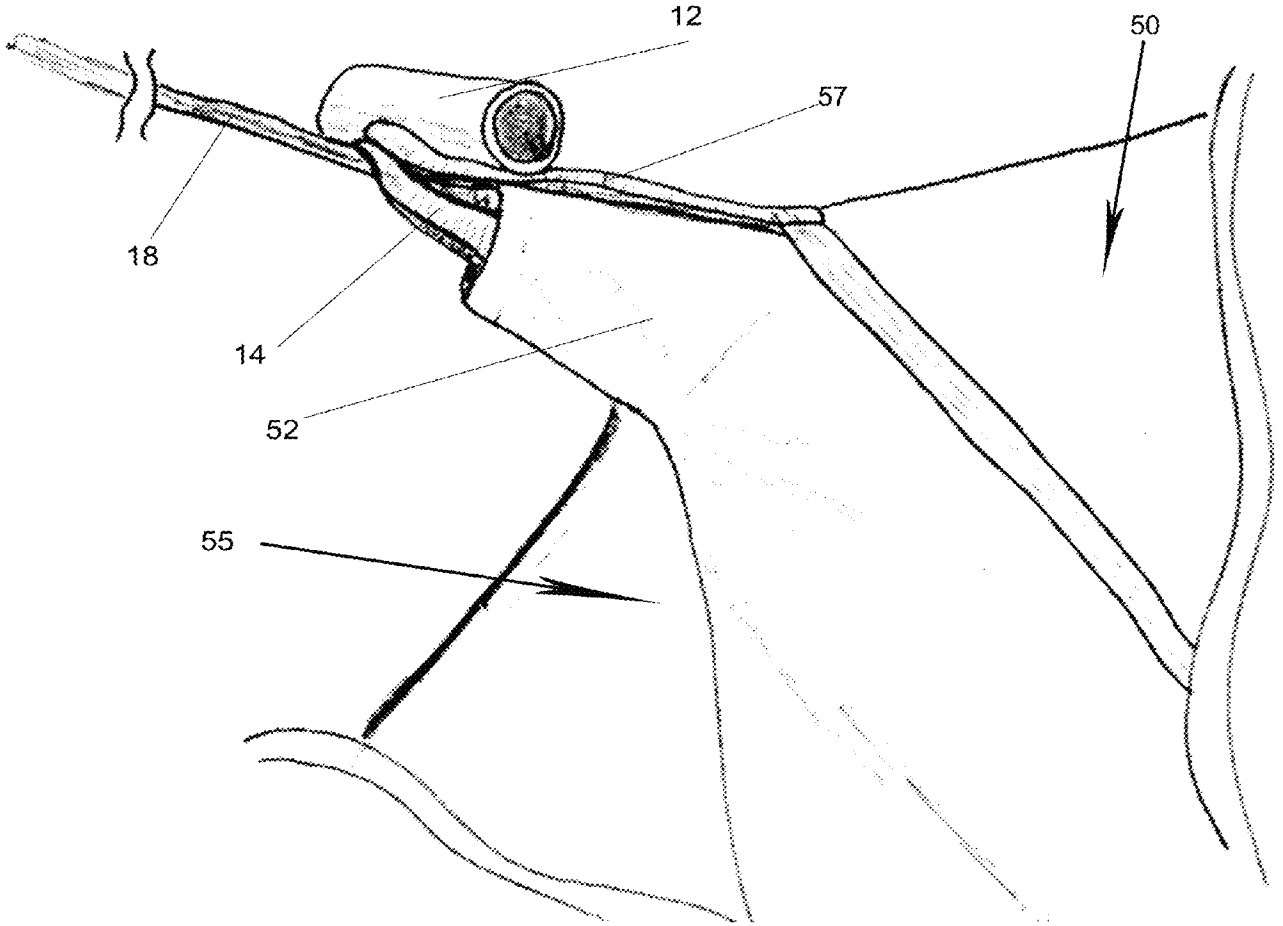
FIG. 15 illustrates the rainfly end walls and rain sleeve, while showing how the rainfly end loop and hammock end loop fit over the same support lines toggle button.

A rain fly 50, which forms a front facing peak 51 and vestibule over the door of the hammock (as shown in FIGS. 12, 13 & 14) and which is made from a waterproof material, will cover the entire hammock. The rain fly has verticals walls 55 (as shown in FIG. 13), on each end that helps protect the hammock in a blowing rain and will give the rain fly its shape once the fly is staked out using adjustable tie outs 53 at each corner of the rain fly. Each end wall also has a protective, form fitting rain sheath 52 that the hammock's webbing loops 14 will be inserted into protecting them from rainwater that runs down the hammock support lines 18. Once the hammock end loops are fed through the rain sheath, the loops are then looped over the support line toggle button 12, hook or carabineer. The rain fly end loops 57 are then attached to the same toggle buttons, hooks or carabineers as the hammock end loops (as shown in FIG. 15) holding the rain fly in place, keeping it with in a few inches of the top enclosure 6, and taut over the hammock body, creating the fly's ridgeline 56 (as shown on FIG. 14).

Figure 6:
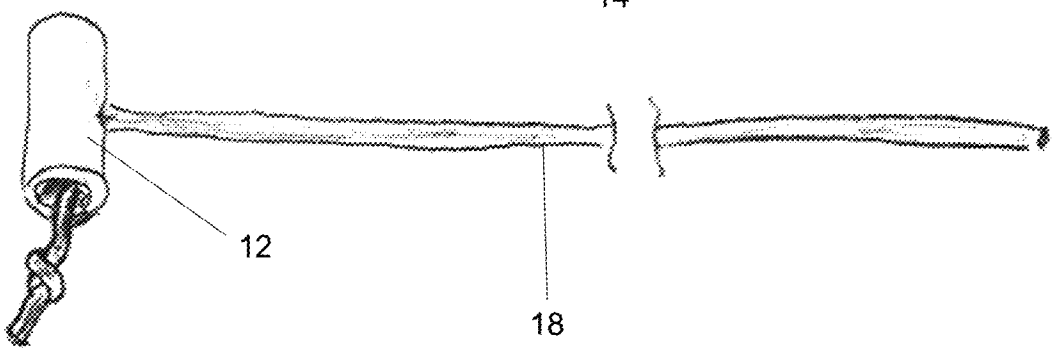
FIG. 6 shows the toggled support line as assembled.

This single axis support line system, which supports both the hammock and rain fly, allows the occupant to set up the hammock and/or fly independent of each other with out having to tie or re-tie other lines. Two separate ropes 18, (the configuration of which is shown in FIGS. 6, 7 & 8) will create the single axis support line and these ropes can be nylon, poly or Amsteal Blue. Each rope will use a toggle button 12, hook or carabineer at one end of each rope to connect to the webbing loops 14 at End Point's 10 & 11 and the webbing loops 57 of the rain fly. The loose end of each rope will be wrapped around a tree or vertical support at each end of the hammock. Since the support lines are not permanently attached to the hammock, this allows the user to attach the support lines 18 to the trees or vertical supports first, then attach the hammock body and/or rain fly to the toggle button, hook or carabineer creating the single axis support line. The hammock or rain fly can be taken down at any time while the support lines stay attached to the trees or vertical supports. This also allows the user to take down one end of the hammock body and move it completely out of the way by stuffing the hammock into the attached stuff sack 15 and closing the stuff sack with the draw cord and cord lock 19, while keeping the rain fly 50 in place during a rain storm, providing more room under the fly for cooking.

Once the rain fly 50 is staked out, the peak of the fly 51, which is at the hammocks entryway, can be adjusted up or down using a hiking pole, kayak paddle, adjustable tent pole 54 or a stick, depending on the weather. At its highest point, the peak provides a protected standing area at the hammock doorway. This allows the occupant to stand or sit in the hammock's doorway during a rainstorm. The peak can be pulled down to a lower position to further protect the hammock's entryway if the storm becomes a hard blowing rain. As another option, for more protection in blowing rain or heavy snow, the vertical end walls as well as a vertical wall at the back of the rain fly and the front vestibule at the fly's peak, can be extended, in manufacturing, to reach the ground, fully enclosing the hammock body but using the same rain fly profile as seen in FIGS. 12-14.

If more room is needed under the fly or if the occupant wishes to camp on the ground, the hammock can be easily pulled off its toggle, hook or carabineer while the rain fly stays in place on the same support line. This is the beauty of this single line system.

| REFERENCES (incorporated herein by reference) | | |
|---|---|---|
| U.S. Pat. No. 4,001,902 | Jan. 11, 1977 | Suspended bed and shelter |
| U.S. Pat. No. 4,021,868 | May 10, 1977 | Contour hammock |
| USD328828 | Aug. 25, 1992 | Enclosed hammock |
| U.S. Pat. No. 6,701,549 | Mar. 9, 2004 | Level hammock |
| U.S. Pat. No. 6,865,757 | Mar. 15, 2005 | Asymmetrical hammock shelter |
| U.S. Pat. No. 7,020,915 | Apr. 4, 2006 | Hammock |
| U.S. Pat. No. 7,178,182 | Feb. 20, 2007 | Suspended sleeping bag |
| U.S. Pat. No. 8,161,991 | Apr. 24, 2012 | Multipurpose camping hammock |

I claim:

1. A fully enclosed hammock shelter for overnight use during cold and warm weather camping comprising, a hammock body made of a fabric sheet which is cut to form a four-sided shape having two congruent opposing sides which form the length and two non-congruent curved or angled opposing ends which form the width and which the size, shape and direction of the curve or angle of the opposing ends will cause one diagonal axis of said four-sided shape to be shorter than the opposing diagonal axis creating a ridge in the hammock's fabric along the axis of the shorter diagonal while causing specific points on both ends of the axis of the longer diagonal to hang lower than said ridge once both hammock ends are gathered and the hammock body is suspended between two points;

a hammock in which a webbing end loop is permanently attached at each end point of the hammock body in such a manner that will support the weight of the occupant once the end loops are connected to the support system which suspends the hammock shelter off the ground;

a support system in which a toggle button is used to connect support ropes to the said webbing end loops of the hammock body allowing the hammock to be suspended off the ground;

a hammock top enclosure which is made from a solid breathable and lightweight nylon or polyester fabric that can be attached to the hammock body enclosing the entire hammock body creating a shelter to trap body heat while allowing body vapor to escape out and embodies a door system for the hammock shelter which is comprised of a zippered door which is made from mesh fabric and attached to said mesh door is a zippered window flap which is made from a solid breathable and lightweight nylon or polyester fabric that can be open or closed to regulate ventilation inside the hammock shelter;

a hammock ridgeline gear loft made of nylon or polyester fabric or mesh which creates a storage area hanging above the occupant by attaching to a ridgeline of the hammock's top enclosure; and a rain fly which will form a peaked vestibule over the hammock's doorway by using a hiking pole, paddle or stick, allowing rain protection for the occupant while standing at the hammock's doorway and is made of waterproof nylon or polyester fabric, and which has vertical walls at each end of said rain fly to maintain the rain fly's shape while providing rain and wind protection and keeping the fly centered over the hammock body using a fitted sheath on said vertical walls in which each said webbing end loop on the hammock body will be inserted into allowing the rain fly to connect to the same toggle button which supports the hammock body thus securing the rain fly in place over the hammock body.

2. The hammock shelter of claim 1, wherein the hammock body in which said webbing is attached creating end loops in which the portion of said webbing which is sewn to the ends of the hammock body is covered by a water proof nylon or polyester fabric fitting on one end of the hammock body and the other end of the hammock body will incorporate a stuff sack made of nylon or polyester in which the second webbing end loop protrudes from the closed end of said stuff sack and allows the entire hammock and rain fly to be placed into the open end of the stuff sack in which said open end can be closed via a draw cord and cord lock.

3. The hammock shelter of claim 1, wherein said hammock top enclosure which is made from a solid breathable and lightweight nylon or polyester fabric that can be attached to the hammock body includes a fixed ridge line in which said fixed ridge line is created by a seam formed by the two sides of the top enclosure being sewn together.

4. The hammock shelter of claim 1, wherein said hammock ridgeline gear loft made of nylon or polyester fabric or mesh in which offers storage on both sides of said ridgeline gear loft and contains an attachment which hangs below said gear loft that can hold an iPhone, iPod or any Smart phone device allowing the occupant to watch and use the device hands free while laying in the hammock and said ridgeline gear loft can be attached to a seam of the hammock's top enclosure.

5. The hammock shelter of claim 1, wherein said fabric sheet is cut to form a four-sided shape with curved or angled ends which consists of one large main pocket made of material such as fleece, flannel, nylon or polyester which is used to hold a closed cell foam or inflatable pad and acts as the bed for an occupant and two additional pockets on both the left and right side of said main pocket and each pocket is used for storage of clothing items which in turn offers added insulation to the hammock shelter.

6. The hammock shelter of claim 3, wherein said hammock top enclosure which is made from a solid breathable and lightweight nylon or polyester fabric that can be attached to the hammock body and encloses the hammock body can be removable from the hammock body.

7. The hammock shelter of claim 1, wherein said support ropes are independent and separate from the hammock shelter and consist of a toggle button, hook or carabineer, on one end of each rope and the loose end of each rope being configured to be tied around a tree or any support allowing the webbing loop at each end point of the hammock body and rain fly to be looped over the said toggle button, hook or carabineer, thus attaching the support ropes to the hammock shelter for the hammock shelter to be suspended between two points.

* * * * *